US007731024B2

(12) United States Patent
Bouno et al.

(10) Patent No.: US 7,731,024 B2
(45) Date of Patent: Jun. 8, 2010

(54) TONGUE-LID PACK FOR ROD-SHAPED SMOKING ARTICLES AND A BLANK THEREOF

(75) Inventors: Naoto Bouno, Tokyo (JP); Masanori Kohama, Hamamatsu (JP); Hiroyuki Yamashita, Hamamatsu (JP)

(73) Assignee: Japan Tobacco Inc., Tokyo (JP)

( * ) Notice: Subject to any disclaimer, the term of this patent is extended or adjusted under 35 U.S.C. 154(b) by 75 days.

(21) Appl. No.: 11/826,034

(22) Filed: Jul. 11, 2007

(65) Prior Publication Data

US 2008/0006544 A1 Jan. 10, 2008

Related U.S. Application Data

(63) Continuation of application No. PCT/JP2006/300221, filed on Jan. 11, 2006.

(30) Foreign Application Priority Data

Jan. 14, 2005 (JP) ..... 2005-007840

(51) Int. Cl.
*B65D 85/10* (2006.01)

(52) U.S. Cl. ..... 206/268; 206/273; 229/160.1

(58) Field of Classification Search ..... 206/268, 206/259, 266, 271, 273, 265, 242, 247, 254, 206/264; 229/87.12, 87.13, 87.14, 160.1
See application file for complete search history.

(56) References Cited

U.S. PATENT DOCUMENTS 329,134 A * 10/1885 Brotz ..... 229/149
624,583 A * 5/1899 Vierengel ..... 229/149
1,432,932 A * 10/1922 Weis ..... 229/131.1
1,433,439 A * 10/1922 Weis ..... 229/149
1,822,512 A * 9/1931 Tanner ..... 229/149
2,361,597 A * 10/1944 Buttery ..... 229/225
2,361,659 A * 10/1944 Smith ..... 229/225
2,951,626 A * 9/1960 Weiss ..... 229/160.1
3,823,865 A * 7/1974 Mechnick ..... 229/146
3,861,583 A * 1/1975 Tingley et al. ..... 229/223
3,910,487 A * 10/1975 Jaeschke ..... 229/225
5,511,658 A * 4/1996 Focke et al. ..... 206/271
5,511,722 A * 4/1996 Dixon ..... 229/225
5,564,562 A * 10/1996 Focke et al. ..... 206/233
6,199,687 B1 * 3/2001 Tambo et al. ..... 206/268
D440,352 S * 4/2001 Gore et al. ..... D27/191

(Continued)

FOREIGN PATENT DOCUMENTS

DE 1054372 B 4/1959

(Continued)

*Primary Examiner*—Ehud Gartenberg
*Assistant Examiner*—Ernesto A Grano
(74) *Attorney, Agent, or Firm*—Birch, Stewart, Kolasch & Birch, LLP.

(57) ABSTRACT

A tongue-lid pack has an outer box (2) whose upper end is open, an inner pack (6) contained in the outer box (2) and having filter cigarettes, and a tongue lid (16) for opening/closing the open end of the outer box (2). A front wall (20) of the outer box (2) has a depression (21) that accepts a tip end portion (26) of a tongue (22) of the tongue lid (16) when the tongue (22) is superimposed upon the front wall (20), and the tip end portion (26) sinks in the front wall (20).

7 Claims, 6 Drawing Sheets

U.S. PATENT DOCUMENTS

| | | | | |
|---|---|---|---|---|
| 6,360,943 | B1 * | 3/2002 | Focke et al. | 229/160.1 |
| 6,474,469 | B1 | 11/2002 | Luton et al. | |
| 6,742,652 | B1 * | 6/2004 | Focke et al. | 206/268 |
| 7,353,940 | B2 * | 4/2008 | Sendo | 206/268 |
| 7,467,711 | B2 * | 12/2008 | Tambo | 206/273 |

FOREIGN PATENT DOCUMENTS

| | | | |
|---|---|---|---|
| JP | 2003-507269 | A | 2/2003 |
| RU | 2 062 739 | C1 | 6/1996 |
| RU | 2 143 390 | C1 | 12/1999 |
| RU | 2 153 451 | C1 | 7/2000 |
| RU | 2 218 297 | C2 | 12/2003 |
| UA | 78 494 | C2 | 4/2007 |
| WO | WO-01/12528 | A1 | 2/2001 |
| WO | WO-2004/064550 | A1 | 8/2004 |

* cited by examiner

TONGUE-LID PACK FOR ROD-SHAPED SMOKING ARTICLES AND A BLANK THEREOF

This application is a Continuation of copending PCT International Application No. PCT/JP2006/300221 filed on Jan. 11, 2006, which designated the United States, and on which priority is claimed under 35 U.S.C. §120. This application also claims priority under 35 U.S.C. §119(a) on Patent Application No(s). 2005-007840 filed in Japan on Jan. 14, 2005. The entire contents of each of the above documents is hereby incorporated by reference.

TECHNICAL FIELD

The present invention relates to a tongue-lid pack for containing rod-shaped smoking articles such as cigarettes and filter cigarettes, and a blank therefor.

BACKGROUND ART

A tongue-lid pack of this type is disclosed, for example, in International Publication WO 2004/064550. This well-known pack includes an outer box with an open upper end, an inner pack contained in the outer box and having a bundle of rod-shaped smoking articles and an inner wrapper for wrapping the bundle, and a tongue lid hingedly jointed to the outer box and opens/closes the outer box.

More specifically, the tongue lid includes a lid for opening and closing the opening of the outer box and a tongue extending from the lid. The lid and the tongue are demarcated by a fold line. Right after the tongue-lid pack is fabricated, the tongue of the tongue lid is superimposed upon the front wall of the outer box.

The outer box further includes an insertion slit. This insertion slit is formed in the front wall of the outer box. After being opened for the first time, the tongue lid can close the opening of the outer box with the tongue, and is kept in a closed position by the tip end of the tongue being inserted into the outer box through the insertion slit.

As mentioned above, immediately after the fabrication of the tongue-lid pack, the tongue of the tongue lid is in the position where it is superimposed upon the front wall of the outer box and stands out from the front wall of the outer box. For this reason, when the tongue-lid pack is taken out from a wrapping device after being fabricated in the device, or when the tongue-lid pack in a vending machine is distributed from the machine, the tip end of the tongue lid of the tongue-lid pack catches on a transfer path in the wrapping device or vending machine, and the pack lodges in the transfer path in some cases.

It is an object of the present invention to provide a tongue-lid pack that enables a stable release of the pack from a wrapping device or a vending machine, and a blank therefor.

DISCLOSURE OF THE INVENTION

In order to achieve the above-mentioned object, a tongue-lid pack of the present invention includes an outer box of which an upper end is open, the outer box having a front wall and an insertion slit formed in the front wall, an inner pack contained in the outer box, the inner pack having a bundle of rod-shaped smoking articles and an inner wrapper wrapping the bundle, and a tongue lid hingedly jointed to a rear edge of the open end of the outer box. The tongue lid includes a lid for covering the open end of the outer box and a tongue connected to the lid through a fold line. The tongue has such a size as to cover the insertion slit when superimposed upon the front wall of the outer box, and has a tip end portion that is insertable into the outer box through the insertion slit. The front wall of the outer box is provided with a depression that can accept the tip end portion of the tongue when the tongue is superimposed upon the front wall. The depression makes the tip end portion of the tongue sink in the front wall.

Immediately after the tongue-lid pack is fabricated, the tongue of the tongue lid is superimposed upon the front wall of the outer box, and the tip end portion of the tongue is fitted in the depression of the front wall. Since the tip end portion of the tongue is sunk in the front wall of the outer box, it does not protrude from the front wall like a relief. Therefore, when the tongue-lid pack of the present invention is transferred through a transfer path and released from a wrapping device or a vending machine, the tip end portion of the tongue does not catch on the transfer path, which ensures a stable release of the tongue-lid pack.

More specifically, the tongue has a bend line for demarcating the tongue into the tip end portion and a base portion. When the tongue is superimposed upon the front wall of the outer box, the tip end portion of the tongue is directed toward a bottom of the depression by being bent along the bend line.

In this case, since the tip end portion of the lid is directed toward the bottom of the depression when the lid of the tongue lid is superimposed upon the front wall of the outer box, even if the tongue interferes with the transfer path at the time of transferring and releasing the tongue-lid pack, the tip end portion of the tongue is pressed into the depression. This prevents the tongue from catching on the transfer path.

Preferably, the tip end portion of the tongue has a tapered shape, and the depression has a shape matching with the tip end portion of the tongue. Further preferably, the depression has depth that gradually increases toward the tip end portion of the tongue.

Immediately after the tongue-lid pack is fabricated, the tongue lid may further have an adhesion point at which the tongue is detachably bonded to the front wall of the outer box. In this case, after the fabrication of the tongue-lid pack, the tongue is bonded to the front wall of the outer box until the tongue lid is opened for the first time. Therefore, even if moisture of the tongue lid is changed, the tip end portion of the tongue does not protrude from the depression of the front wall to rise from the front wall.

The inner wrapper of the inner pack has two paper layers that form outer and inner surfaces and a shielding layer sandwiched between the paper layers. The shielding layer protects the rod-shaped smoking articles contained in the inner pack from moisture and prevents flavor and aroma of the rod-shaped smoking articles from escaping from the inner pack. The shielding layer of the inner wrapper exerts a function of film packaging for a conventional hinge-lid pack, so that the tongue-lid pack of the present invention does not require film packaging. This simplifies a process for fabricating the pack of the invention and makes it possible to offer the pack at a low price.

The tongue-lid pack of the invention may further include a connection piece exposed outside of the tongue-lid pack and detachably connects the outer box and the tongue lid. When the tongue lid is first opened, the connection piece is detached from the tongue lid, which leaves braking traces both in the connection piece and the tongue lid. Therefore, the connection piece effectively functions as tamper prevention on the tongue-lid pack.

The present invention provides a blank for the above-mentioned tongue-lid pack. The blank includes a front panel for forming the front wall of the outer box and a depression formed in the front panel, for accepting the tip end portion of the tongue to make the tip end portion sink in the front wall of the outer box. The blank of the invention can be easily obtained by forming the depression in the front panel.

BEST MODE OF CARRYING OUT THE INVENTION

Figure 1:
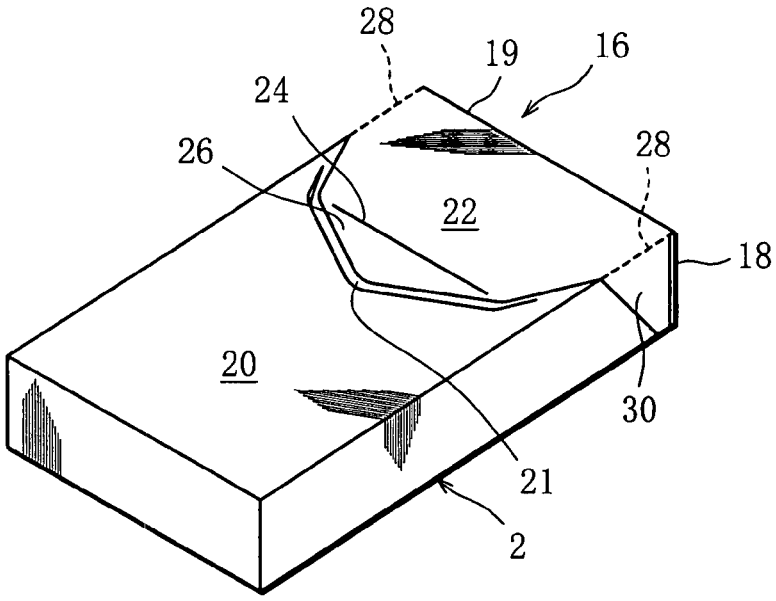
FIG. 1 is a perspective view showing a tongue-lid pack according to one embodiment immediately after fabrication of the pack.
Figure 2:
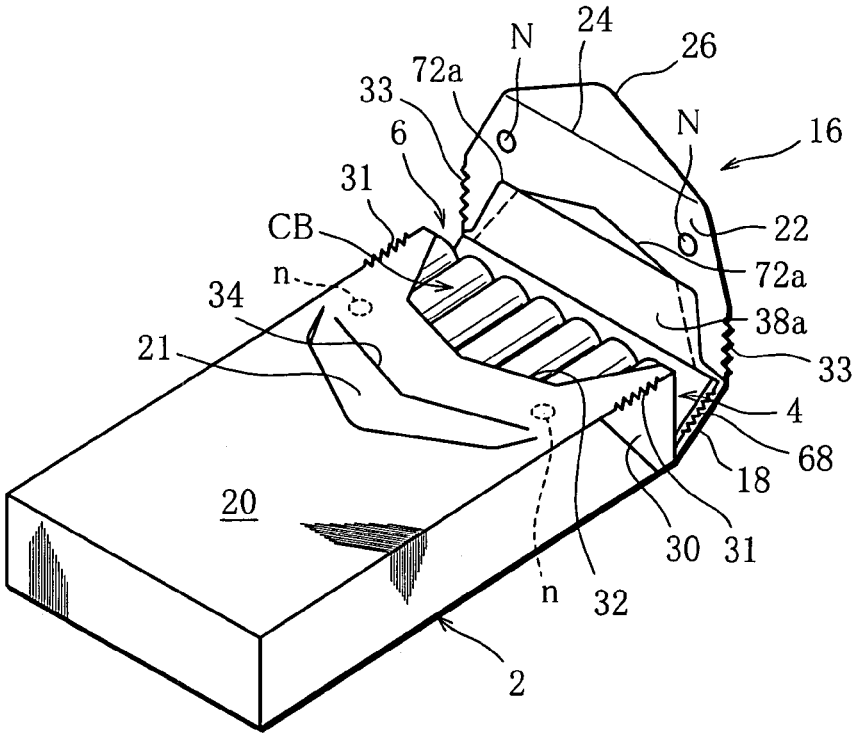
FIG. 2 is a perspective view showing a state in which a tongue lid of the pack of FIG. 1 is opened.

FIGS. 1 and 2 show a tongue-lid pack for filter cigarettes.

The tongue-lid pack includes an outer box 2. An upper end of the outer box 2 is formed as a rectangular open end 4. Contained in the outer box 2 is an inner pack 6, which includes a cigarette bundle CB and an inner wrapper wrapping the cigarette bundle CB therein. The cigarette bundle CB has twenty filter cigarettes.

The tongue-lid pack further includes a tongue lid 16. The tongue lid 16 is hingedly jointed to a rear edge of the open end 4, and opens and closes the open end 4. When in a closed position, the tongue lid 16 has a lid 18 covering the open end 4 and a tongue 22 extending from the lid 18. The tongue 22 and the lid 18 are demarcated from each other by a fold line 19.

When the tongue-lid pack is fabricated, the tongue 22 is superimposed upon a front wall 20 of the outer box as illustrated in FIG. 1. The tongue 22 has an insertion flap 26 in a tip end portion thereof. The insertion flap 26 and a base portion of the tongue 22 are demarcated by a bend line 24. According to the present embodiment, the base portion of the tongue 22 has width that gradually decreases toward the insertion flap 26. The insertion flap 26 is also tapered toward the tip end thereof.

A depression 21 is formed in the front wall 20 of the outer box 2 by press work. The depression 21 has a shape identical to the shape of the tip end portion of the tongue 22 and is capable of accepting the insertion flap 26 of the tongue 22. The depression 21 has depth that gradually increases toward a bottom wall of the outer box 2. Therefore, when the tongue 22 is fitted into the depression 21 of the front wall 20, the depression 21 causes the tip end of the insertion flap 26 to sink in the front wall 20.

Figure 3:
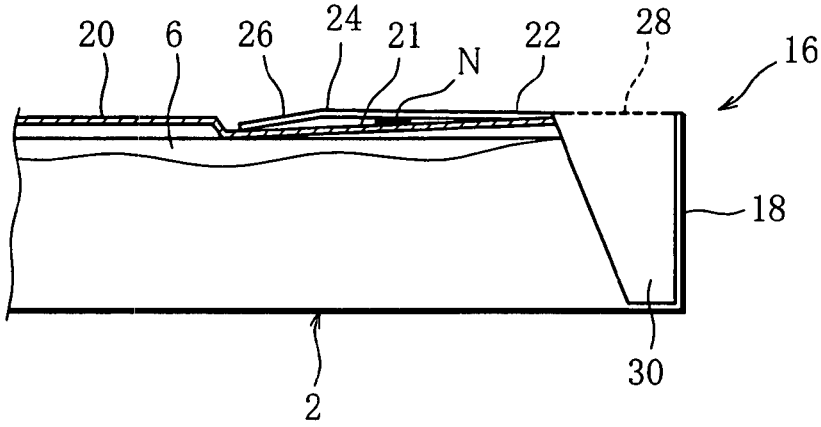
FIG. 3 is a side view showing the pack of FIG. 1, partially broken away.

According to the present embodiment, as is clear from FIG. 3, the insertion flap 26 is folded along the bend line 24 into a position directed toward a bottom of the depression 21. For this reason, the tip end of the insertion flap 26 is in contact with the bottom of the depression 21.

As is apparent from the foregoing description, when the tongue 22 is superimposed upon the front wall 20 of the outer box 2, the tip end portion of the tongue 22, namely the tip end of the insertion flap 26, is received in the depression 21. Therefore, the tip end of the insertion flap 26 does not protrude from the front wall 20 like a relief. When the tongue-lid pack is transferred through a transfer path of a wrapping device or vending machine, the insertion tip 26 of the tongue 22 does not get caught in the transfer path. This reliably prevents the tongue-lid pack from getting caught in the transfer path. Consequently, a stable transfer of the tongue-lid pack in the wrapping device or a stable release of the tongue-lid pack from the vending machine can be accomplished.

The depression 21 does not have to be large enough to accept the whole insertion flap 26. The depression 21 is sufficiently large as long as it has a size capable of accepting at least the tip end of the insertion flap 26. The shape of the depression 21 is not limited to one illustrated in the drawing, and the bend line 24 of the tongue 22 is less than necessary.

According to the present embodiment, as illustrated in FIGS. 2 and 3, the tongue 22 has a pair of adhesion points N on an inner surface thereof. The adhesion points N are positioned in respective side edge portions of the tongue 22. When the tongue-lid pack is fabricated, the adhesion points N detachably attach the tongue 22 to the front wall 20 of the outer box. When the tongue 22 is later detached from the front wall 20, there leaves in the front wall 20 traces n shown in a broken-line circle as illustrated in FIG. 2. The traces n indicate that the tongue 22 has been bonded to the front wall 20.

Lugs 30 are jointed to respective side edges of the tongue 22 through cut-off lines 28. The cut-off lines 28 are shown by broken lines in FIGS. 1 and 3. When the tongue-lid pack is fabricated, the lugs 30 are bonded to respective side walls of the outer box 2. When the tongue lid 16 is first opened, however, the tongue 22 is detached from the lugs 30 along the cut-off lines 28. Accordingly, as illustrated in FIG. 2, there leaves traces 31 and 33 both in the tongue 22 and the lugs 30. The traces 31 and 33 indicate that the tongue lid 16 has already been opened.

When the tongue lid 16 is opened, as is obvious from FIG. 2, a U-shaped cut area 32 is formed in the front wall 20 of the outer box 2. The cut area 32 extends from an open end 4 of the outer box 2. Simultaneously with the formation of the cut area 32, a part of an inner wrapper 9 of the inner pack 6 which corresponds to the cut area 32 is cut away. As a result, a part of the cigarette bundle CB contained in the inner pack 6 is exposed through the cut area 32. This makes it possible to take the filter cigarettes in the inner pack 6 out of the outer box 2 through the cut area 32 without difficulty.

When the tongue lid 16 is opened, an insertion slit 34 is exposed in the front wall 20 of the outer box 2 as illustrated in FIG. 2. The insertion slit 34 is previously formed in the front wall 20. Until the tongue lid 16 is opened for the first time, the insertion slit 34 is in a position covered with the tongue 22 of the tongue lid 16. More specifically, the insertion slit 34 is positioned in a base portion of the depression 21, that is, a portion where the depression 21 starts appearing (a portion in which the depth of the depression 21 is shallow).

As is clear from FIG. 2, the insertion slit 34 is formed in a shape of the letter V splayed toward the cut area 32. Accordingly, when the tongue lid 16 is opened and then closed again, the insertion flap 26 of the tongue lid 16 can be easily inserted into the outer box 2 through the insertion slit 34. When the insertion flap 26 is inserted into the insertion slit 34, the insertion flap 26 is sandwiched between the front wall 20 and the inner pack 6, and the tongue lid 16 is maintained in a closed position.

Since the depression 21 is formed in the front wall 20, a gap between a portion of an inner surface of the front wall 20 which corresponds to the depression 21 and the inner pack 6 is reduced. In a case that the number of the filter cigarettes taken out from the outer box 2 is small after the tongue-lid pack is opened, the front wall 20 and the inner pack 6 are capable of holding the insertion flap 26 with a great pinching force in cooperation with each other. The insertion slit 34 is not limited to the V-like shape, and may be formed in a shape of a circular arc which is concave with respect to the cut area 32.

Figure 4:
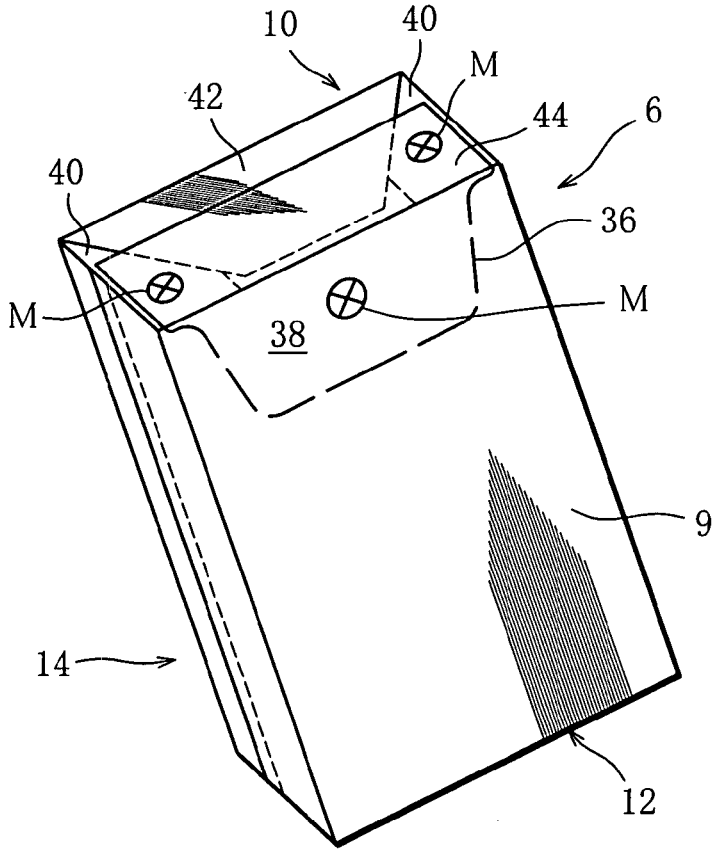
FIG. 4 is a perspective view showing an inner pack contained in the pack of FIG. 1.

FIG. 4 shows the inner pack 6 in detail.

As stated above, the inner pack 6 has an upper face 10 and a bottom face 12. The upper face 10 and the bottom face 12 are formed by folding the inner wrapper 9. One lateral face 14 of the inner pack 6 is formed by superimposing both ends of the inner wrapper 9.

In order to enable the detachment of the inner wrapper 9, the inner wrapper 9 has a U-shaped cut line 36 corresponding to the cut area 32 as illustrated in FIG. 4. The cut line 36 is positioned on the side of the upper face 10 of the inner pack 6. The cut line 36 demarcates a to-be-detached portion 38 in the inner wrapper 9. The to-be-detached portion 38 includes a part of the inner wrapper 9 that forms the upper face 10 of the inner pack 6. More specifically, as illustrated in FIG. 4, a portion of the inner wrapper 9 which forms the upper face 10 has right and left end flaps 40, and an inner flap 42 and an outer flap 44 that are superimposed upon in the end flaps 40 in the order named. The to-be-detached portion 38 includes the outer flap 44.

Figure 5:
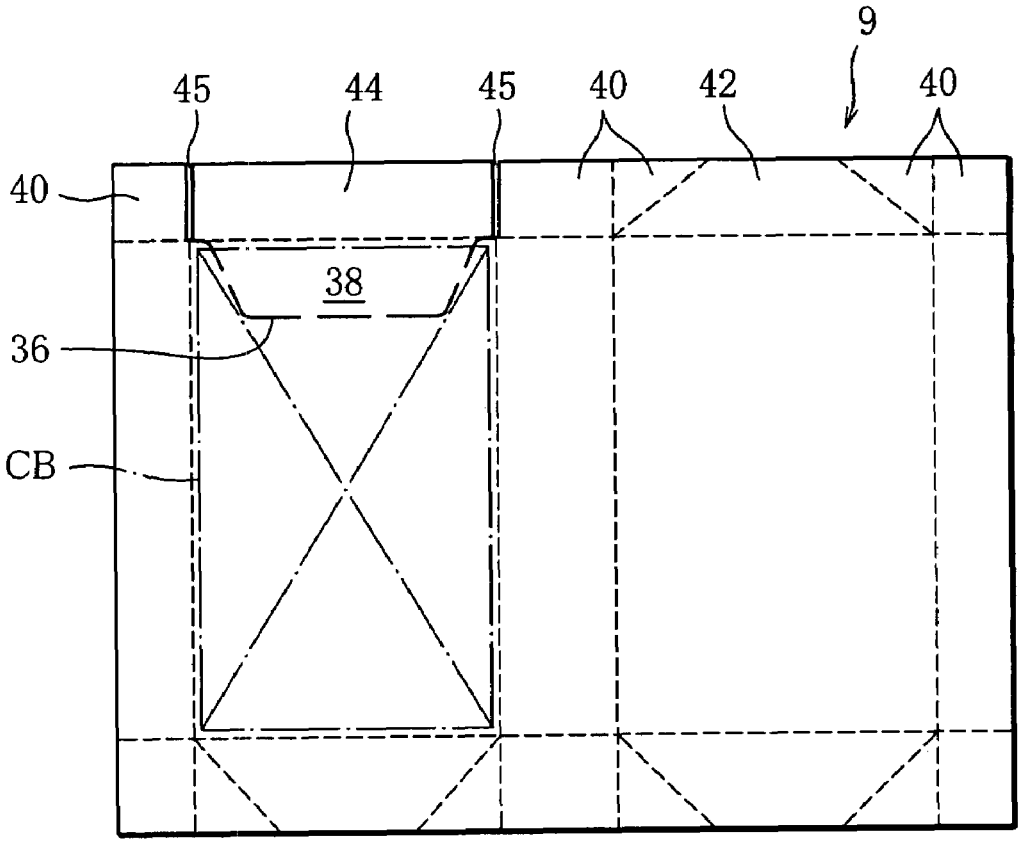
FIG. 5 is a developed view of an inner wrapper used for the inner pack of FIG. 4.

FIG. 5 is a developed view of the inner wrapper 9. As is apparent from the developed view of FIG. 5, a portion forming the outer flap 44 is not jointed to a portion forming the end flap 40. These portions are separated from each other by a pair of slits 45. The slits 45 may be cut lines similar to the cut line 36.

Broken lines in FIG. 5 show fold marks that are formed in the inner wrapper 9 when the inner wrapper 9 is folded around the cigarette batch CB.

Figure 6:
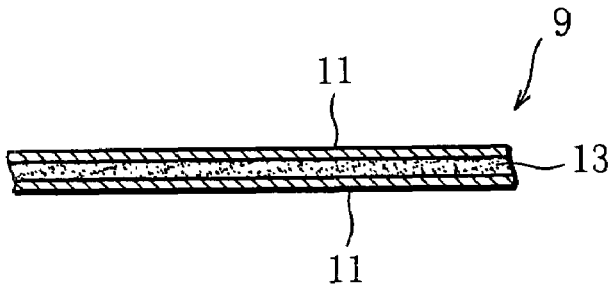
FIG. 6 is a sectional view of the inner wrapper of FIG. 5.

FIG. 6 is a sectional view of the inner wrapper 9.

The inner wrapper 9 has a triple-layer structure, which includes two paper layers 11 forming outer and inner surfaces and a shielding layer 13 sandwiched between the paper layers 11. Each of the paper layers 11 is made of glassine paper, and the shielding layer 13 paraffin wax. The shielding layer 13 not only protects the cigarette bundle CB contained in the inner pack 6 from outside moisture but also prevents flavor or aroma from escaping from the cigarette bundle CB. Therefore, the tongue-lid pack of the present embodiment does not need film packaging with tear tape for covering the outer box 2 and the tongue lid 16.

When the tongue lid 16 is first opened, the traces 31 and 33 are left in both the tongue 22 and the lugs 30. The traces 31 and 33 are visible from outside the tongue-lid pack, so that they effectively function as tamper prevention on the cigarette bundle CB of the inner pack 6 as with the tear tape of the film packaging mentioned before.

Figure 7:
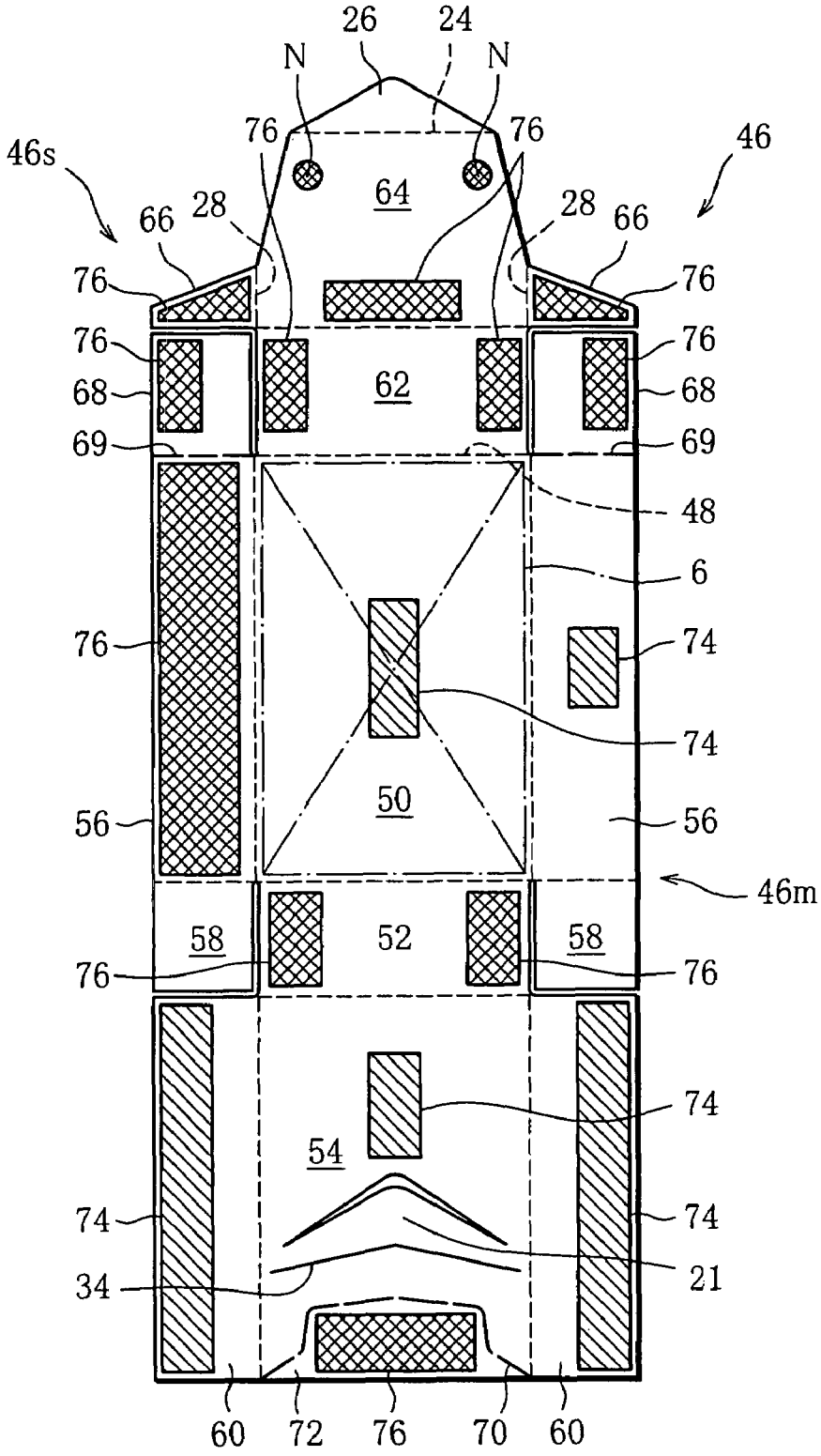
FIG. 7 is a view showing a blank for fabricating the pack of FIG. 1.

FIG. 7 shows a blank 46 for forming the outer box 2 and the tongue lid 16, that is, an inner surface of the blank 46.

The blank 46 includes a main section **46*m* for forming the outer box 2 and a subsection 46*s* for forming the tongue lid 16. The sections 46*m* and 46*s* are arranged side by side in a longitudinal direction of the blank 46 and are jointed to each other through a fold line 48 shown by a broken line. The fold line 48 forms the above-mentioned hinge. In descriptions below, other fold lines are all shown by broken lines in FIG. 7**.

The main section **46*m* has three panels, which are arranged in the order in a longitudinal direction of the main section 46*m*. The panels are demarcated by fold lines. Specifically, the panels include a rear panel 50, an outer bottom panel 52 and a front panel 54 in the order named from the side of the subsection 46*s*. The rear panel 50 and the front panel 54 form a rear wall and the front wall 20 of the outer box 2, respectively. When the tongue-lid pack is fabricated, the outer bottom panel 52 forms a part of the bottom wall of the outer box 2**.

Inner side flaps 56 are jointed to respective side edges of the rear panel 50 through fold lines. Inner bottom flaps 58 are jointed to lower edges of the inner side flaps 56 through fold lines. The inner bottom flaps 58 are disposed respective sides of the outer bottom panel 52. When the tongue-lid pack is fabricated, the inner bottom flaps 58 form the bottom wall of the outer box 2 together with the outer bottom panel 52.

Outer side flaps 60 are jointed to respective side edges of the front panel 54 through fold lines. When the tongue-lid pack is fabricated, the outer side flaps 60 form side walls of the outer box 2 together with the respective inner side flaps 56.

The subsection **46*s* includes a lid panel 62 and a tongue panel 64. The panels 62 and 64 are arranged in the order named from the side of the rear panel 50. The lid panel 62 is connected to the rear panel 50 through a fold line, and the tongue panel 64 to the lid panel 62 through a fold line. The tongue panel 64 has a bend line 24. When the tongue-lid pack is fabricated, the bend line 24 forms a tip end portion of the tongue panel 64 as the insertion flap 26. Lug flaps 66 are jointed to respective side edges of the tongue panel 64 through cut lines 28. The lug flaps 66 form the lugs 30** when the tongue-lid pack is fabricated.

Inner top flaps 68 are arranged on respective sides of the lid panel 62. The inner top flaps 68 are jointed to upper edges of the respective inner side flaps 56 through cut lines 69. When the tongue-lid pack is fabricated, the inner top flaps 68 form the lid 18 together with the lid panel 62.

The front panel 54 has a cut line 70 in addition to the insertion slit 34. The cut line 70 is substantially U-shaped and demarcates a to-be-cut-off portion 72 in a lower edge portion of the front panel 54.

The front panel 54 has the depression 21. The depression 21 is protruding on an inner side of the front panel 54 like a relief as viewed in the thick direction of the front panel 54 as is apparent from the foregoing descriptions.

The back side of the blank 46 is applied with glue in given places. Glue-applied areas 74 are shown by hatched patterns in FIG. 7. When the tongue-lid pack is fabricated, that is, when the blank 46 is folded around the inner pack 6, the glue-applied areas are used for connection between the panels and the flaps, connection between the flaps or connection of the panels and the flaps with respect to the inner pack 6.

The glue-applied areas 74 are provided to a blank for a conventional pack. The blank 46 for the tongue-lid pack of the present invention further has glue-applied areas 76 other than the glue-applied areas 74. The glue-applied areas 76 are shown by cross-hatched patterns in FIG. 7. Concretely, the glue-applied areas 76 are formed in the to-be-cut-off portion 72, both side portions of the outer bottom panel 52, one of the inner side flaps 56, both side portions of the lid panel 62, the inner top flaps 68 and the lug flaps 66.

The tongue panel 64 has the adhesion points N in right and left parts thereof. The adhesion points N are formed by applying the tongue panel 64 with glue that is low in adhesivity.

A function of the glue-applied areas 76 and the adhesion points N will become clear from a process of fabricating the tongue-lid pack which will be described with reference to FIGS. 8 to 10.

Figure 8:
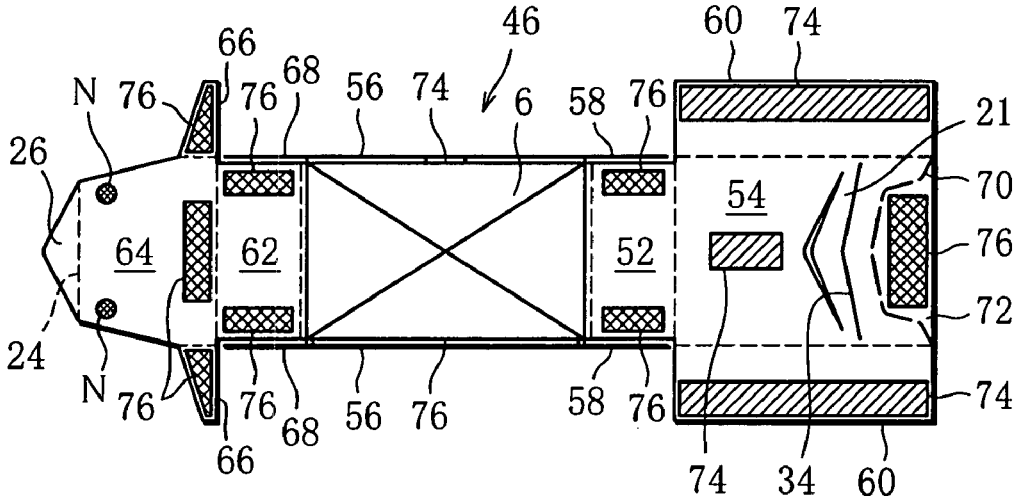
FIG. 8 is a view showing an initial stage of a process of folding the blank of FIG. 7.

As illustrated in FIG. 8, the inner pack 6 is placed on the inner side of the blank 46, that is, the rear panel 50. The inner pack 6 is bonded to the rear panel 50 through the glue-applied area 74. The inner side flaps 56 are subsequently folded against respective lateral faces of the inner pack 6. The inner side flaps 56 are bonded to the inner pack 6 through the glue-applied areas 74 and 76. The folding of the inner side flaps 56 brings the inner bottom flaps 58 and the inner top flaps 68, which are jointed to both ends of the inner side flaps 56, into a position parallel to the respective lateral faces of the inner pack 6.

One of the inner side flaps 56 which has the glue-applied area 76 is bonded to the one lateral face 14 of the inner pack 6 (see FIG. 4), and thereby seals the one lateral face 14 of the inner pack 6. In other words, both the ends of the inner wrapper 9 which are superimposed upon each other to form the one lateral face 14 are bonded to the inner side flap 56 through the glue-applied area 76 over the entire longitudinal area of the inner pack 6. Therefore, the inner pack 6 is enhanced in sealability.

Figure 9:
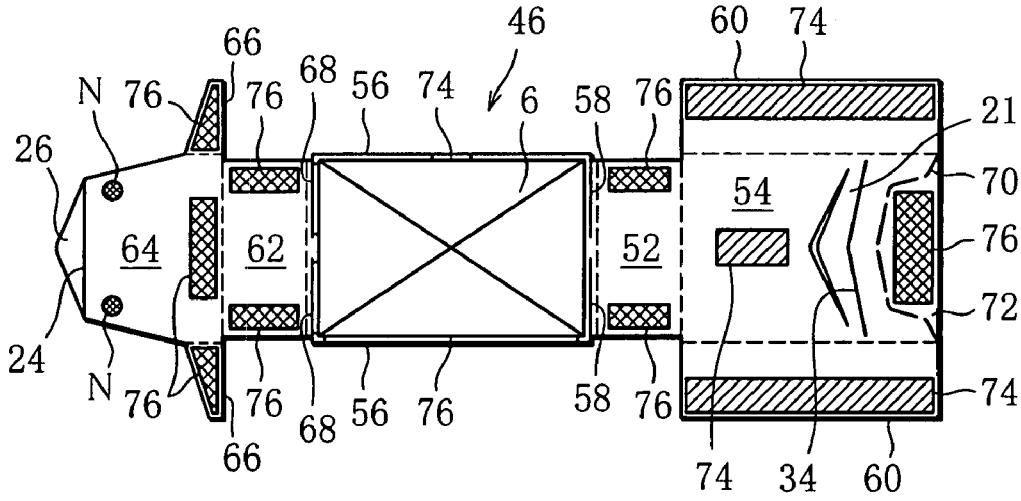
FIG. 9 is a view showing a state in which the folding of the blank is further advanced from the state shown in FIG. 8.

Thereafter, as illustrated in FIG. 9, the inner bottom flaps 58 are folded against the bottom face of the inner pack 6. At the same time as the folding, the inner top flaps 68 are folded along the cut lines 69 (see FIG. 7) against the upper face 10 of the inner pack 6 (see FIG. 4). Since the inner top flaps 68 have the glue-applied areas 76, the inner top flaps 68 are bonded to the upper face 10 of the inner pack 6, namely both the end portions of the outer flap 44 forming the upper face 10, through the glue-applied areas 76. Bonding positions of the inner top flaps 68 and the outer flap 44 are shown by mark M in FIG. 4.

Simultaneously with the folding of the flaps 58 and 68, the insertion flap 26 of the tongue panel 64 is bent along the bend line 24 and is slightly raised toward the inner pack 6.

Figure 10:
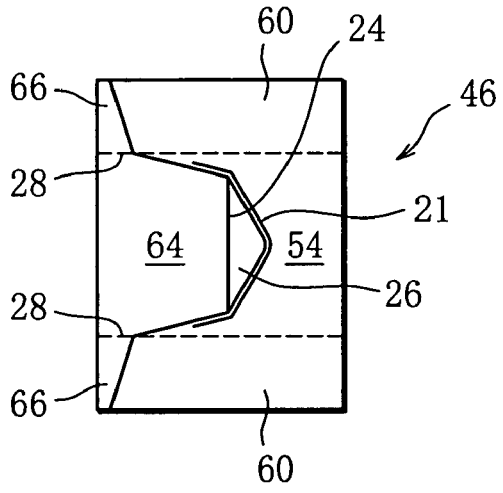
FIG. 10 is a view showing a state in which the folding of the blank is further advanced from the state shown in FIG. 9.

Subsequently, as illustrated in FIG. 10, the outer bottom panel 52 is folded against the bottom face of the inner pack 6 along with the front panel 54. The outer bottom panel 52 is bonded to the inner bottom flaps 58, which have already been folded, through the glue-applied areas 76. At this point of time, the bottom wall of the outer box 2 is formed.

The inner bottom flaps 58 and the outer bottom panel 52 which form the bottom wall of the outer box 2 are bonded to each other through the glue-applied areas 76. This improves sealability of the outer box 2 with respect to the inner pack 6.

Thereafter, the front panel 54 is folded toward the inner pack 6 along with the outer side flaps 60 and bonded to a front face of the inner pack 6 through the glue-applied area 74. At the same time as this adhesion, the to-be-cut-off portion 72 of the front panel 54 is bonded to the to-be-detached portion 38 of the inner wrapper 9 of the inner pack 6 through the glue-applied area 76. A bonding position of the to-be-cut-off portion 72 and the to-be-detached portion 38 is shown by a mark M in FIG. 4.

Upon completion of the folding of the front panel 54, the lid panel 62 is folded toward the inner pack 6 along with the tongue panel 64 and bonded to the inner top flaps 68, which have already been folded, through the glue-applied areas 76. At this point of time, the inner top flaps 68 and the lid panel 62 form the lid 18 of the tongue lid 16.

It should be noted that the lid panel 62 is bonded to the to-be-detached portion 38 of the inner pack 6 (outer flap 44) through the inner top flaps 68, and that the inner top flaps 68 are detachable from the respective inner side flaps 56 along the cut lines 69.

In the next place, as illustrated in FIG. 10, the tongue panel 64 is folded-toward the front panel 54 that has already been folded, and is superimposed upon the front panel 54. At this point, the tongue panel 64 covers the insertion slit 34 of the front panel 54, and the insertion flap 26 of the tongue lid 74 is fitted into the depression 21 so as to coincide with the depression 21. Since the insertion flap 26 is already in a bent position as described, the tip end of the insertion flap 26 is brought into contact with the bottom of the depression 21 (see FIG. 3). The tongue panel 64 is detachably bonded to the front panel 54 at the right and left adhesion points N.

The tongue panel 64 is bonded to the to-be-cut-off portion 72 of the front panel 54 through the glue-attached area 76. The lug flaps 66 of the tongue panel 64 are superimposed upon the respective outer side flaps 60 of the front panel 54.

Since the to-be-cut-off portion 72 is already bonded to the to-be-detached portion 38 of the inner pack 6 as described, the tongue panel 64 is bonded to the to-be-detached portion 38 with the to-be-cut-off portion 72 interposed therebetween.

Subsequently, from the state shown in FIG. 10, the outer side flaps 60 of the front panel 54 are folded toward the respective lateral faces of the inner pack 6 along with the lug flaps 68. The outer side flaps 60 are superimposed upon the respective inner side flaps 56 that have already been folded, and are bonded to the inner side flaps 56 through the glue--applied areas 74. Upon the formation of both the side walls of the outer box 2, the tongue-lid pack (see FIG. 1) is completed. The tongue-lid pack has the lugs 30 in both the side walls of the outer box.

The above-described folding procedure of the blank 46 is virtually the same as that of a conventional blank. Therefore, the tongue-lid pack of the present invention can be fabricated simply by adding a glue applicator, not shown, for forming the glue-applied areas 76 and the adhesion points N to a conventional packing machine.

When the tongue-lid pack of FIG. 1 is first opened, the tongue 22 of the tongue lid 16 is raised from the insertion flap 26 side. As the tongue 22 is raised, the adhesion between the front wall 20 of the outer box 2 and the tongue 22 in the right and left adhesion points N is broken off. At the same time, the to-be-cut-off portion 72 is cut away from the front wall 20 of the outer box 2 along the cut line 70, and the to-be-detached portion 38 of the inner wrapper 9 is cut off along the cut line 36.

When the tongue 22 is further raised, the tongue 22 is detached from the lugs 30 along the cut lines 28. The inner top flaps 68 forming the lid 18 are then cut away from the respective inner side flaps 56 along the cut lines 69 (see FIG. 1).

Since the lugs 30 are exposed outside of the outer box 2 as stated, after the tongue 22 is cut off from the lugs 30, this leaves the traces 31 and 33 in both the outer box 2 and the lid 22. The traces 31 and 33 serve as marks indicating that the tongue-lid pack has already been opened. Therefore, the lugs 30 effectively function as tamper prevention.

After the tongue 22 is detached from the lugs 30, it is possible to widely turn the tongue lid 16 around the hinge (fold line 48). When the tongue lid 16 is widely turned in this manner, the to-be-cut-off portion 72 is cut off from the front wall 10 of the outer box 2, to thereby form the cut area 32 in the front wall 10. The to-be-detached portion 38 is then cut away from the inner wrapper 9 in the inner pack 6. Therefore, as illustrated in FIG. 2, a part of the cigarette bundle CB contained in the inner pack 6 is exposed through the cut area 32. Furthermore, a part of an upper end of the cigarette bundle CB is also exposed from the upper face 10 of the inner pack 6. This makes it easy to access the filter cigarettes in the inner pack 6.

After being cut off, the to-be-cut-off portion 72 and the to-be-detached portion 38 form a cut piece 72*a* and a detached piece 38*a*, respectively. The cut piece 72*a* and the detached piece 38*a* are bonded together through the glue-applied area 76, and moreover the cut piece 72*a* is bonded to the inner side of the tongue 22 through the glue-applied area 76. Therefore, the cut piece 72*a* and the detached piece 38*a* are maintained in a position bonded to the inner side of the tongue 22 as illustrated in FIG. 2. The cut piece 72*a* and the detached piece 38*a* never stick out from the tongue lid 16. As a result, it is not required to dispose of the cut piece 72*a* and the detached piece 38*a* when the tongue-lid pack is first opened. In later time, the cut piece 72*a* and the detached piece 38*a* are discarded with the tongue-lid pack.

The outer flap 44 of the to-be-detached portion 38 is bonded to the inner top flaps 68 through the glue-applied portions 76 as described. Accordingly, the cutout of the to-be-detached portion 38 which involves the turning operation of the tongue lid 16 can be smoothly carried out.

The present invention is not limited to the above embodiment and may be modified in various ways.

Figure 11:
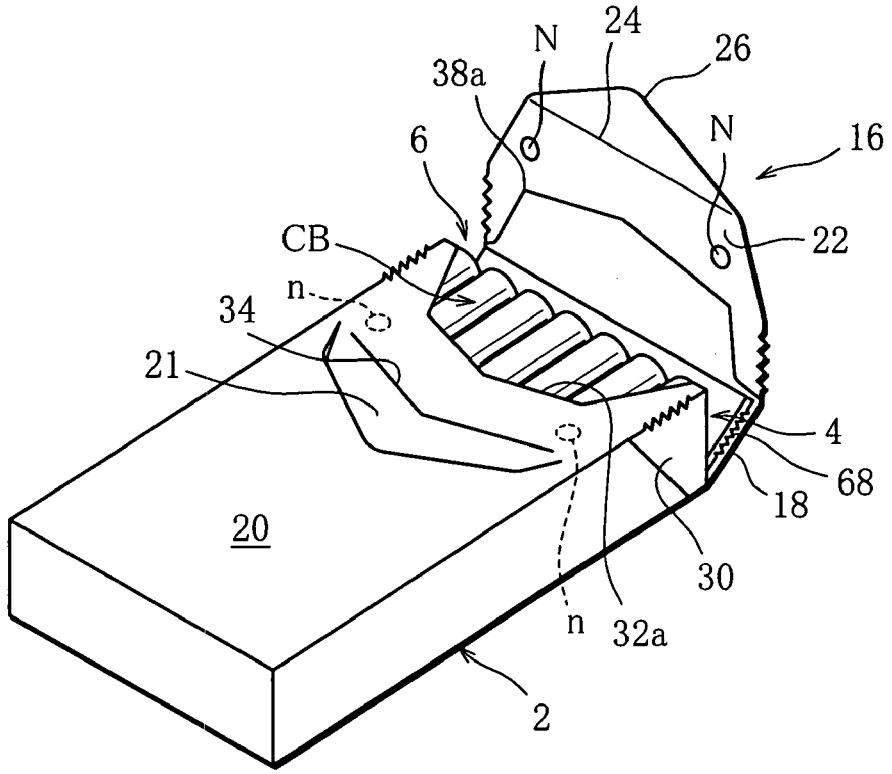
FIG. 11 is a perspective view showing a tongue-lid pack as a modification example in an unfolded state.

According to the embodiment, when the tongue lid 16 is first opened, the cut area 32 is formed in the front wall 20 of the outer box 2. However, the cut area 32 may be previously formed in the front panel 54 of the blank 46. In this case, when the tongue lid 16 is opened as illustrated in FIG. 11, only the to-be-detached portion 38 of the inner wrapper 9 is cut away, and only the detached piece 38*a* is maintained in a position bonded to the back side of the tongue lid 16.

The tongue 22 further includes a circular to-be-cut-off portion instead of or in addition to the lugs 30. The to-be-cut-off portion is detachably bonded to the front wall 20 of the outer box 2. When the tongue lid 16 is first opened, the to-be-cut-off portion is cut away from the tongue 22, to thereby form a circular opening in the tongue 22. The opening forms a trace as tamper prevention like the traces 30 and 31.

The invention claimed is:

1. A tongue-lid pack for rod-shaped smoking articles, comprising:

an outer box of which an upper end is open, said outer box having a front wall and an insertion slit formed in the front wall, an inner pack contained in said outer box, said inner pack having a bundle of rod-shaped smoking articles and an inner wrapper wrapping the bundle, and a tongue lid hingedly jointed to a rear edge of the open end of said outer box, wherein:

said tongue lid includes a lid covering the open end of said outer box, and a tongue connected to the lid through a fold line, wherein:

the tongue has such a size as to cover the insertion slit of the front wall when superimposed upon the front wall of said outer box, and has a tip end portion that is insertable into said outer box through the insertion slit, and wherein:

the front wall of said outer box is provided with a depression that accepts the tip end portion of the tongue when the tongue is superimposed upon the front wall, and said depression makes the tip end portion of the tongue sink in the front wall, wherein the tongue has a bend line for demarcating the tongue into the tip end portion and a base portion. and when the tongue is superimposed upon the front wall of said outer box, the tip end portion of the tongue is directed toward a bottom of said depression by being bent along the bend line, and being flush with the front wall.

2. The tongue-lid pack according to claim 1, wherein:

the tip end portion of the tongue has a tapered shape.

3. The tongue-lid pack according to claim 2, wherein:

said depression has a shape matching with the tip end portion of the tongue.

4. The tongue-lid pack according to claim 3, wherein:

said depression has depth that gradually increases toward the tip end portion of the tongue.

5. The tongue-lid pack according to claim 1, wherein:

immediately after the tongue-lid pack is fabricated, said tongue lid further has an adhesion point at which the tongue is detachably bonded to the front wall of said outer box.

6. The tongue-lid pack according to claim 1, wherein:

the inner wrapper of said inner pack has two paper layers that form outer and inner surfaces and a shielding layer sandwiched between the paper layers, and the shielding layer protects the rod-shaped smoking articles contained in said inner pack from moisture and prevents flavor and aroma of the rod-shaped smoking articles from escaping from said inner pack.

7. The tongue-lid pack according to claim 1, wherein:

the tongue-lid pack further includes a connection piece that is exposed outside of the tongue-lid pack and detachably connects the outer box and the tongue lid; and when said tongue lid is first opened, the connection piece is detached from said tongue lid.

* * * * *